US008434901B2

(12) United States Patent
Jouffrieau

(10) Patent No.: US 8,434,901 B2
(45) Date of Patent: May 7, 2013

(54) LIGHT EMITTING SYSTEM PRODUCTING BEAM WITH ADJUSTABLE WIDTH

(75) Inventor: Matthias Jouffrieau, Lyons (FR)

(73) Assignee: Koninklijke Philips Electronics N.V., Eindhoven (NL)

( * ) Notice: Subject to any disclaimer, the term of this patent is extended or adjusted under 35 U.S.C. 154(b) by 230 days.

(21) Appl. No.: 12/994,897

(22) PCT Filed: Jun. 3, 2009

(86) PCT No.: PCT/IB2009/052350

§ 371 (c)(1),
(2), (4) Date: Nov. 29, 2010

(87) PCT Pub. No.: WO2009/150577

PCT Pub. Date: Dec. 17, 2009

(65) Prior Publication Data

US 2011/0085326 A1 Apr. 14, 2011

(30) Foreign Application Priority Data

Jun. 11, 2008 (EP) ..... 08305245

(51) Int. Cl.
*F21S 4/00* (2006.01)

(52) U.S. Cl.
USPC ..... 362/249.07; 362/285; 362/277; 362/282; 362/287; 362/319; 362/322

(58) Field of Classification Search ..... 362/282, 362/277, 299–300, 307, 311.02, 296.01, 362/249.02–249.03, 235, 238, 239, 240–241, 362/243, 244–247, 217.05–217.07, 225, 362/223–224, 217.02, 333, 336, 326, 327, 362/362/328, 329, 319–325, 280–281, 285, 362/287, 249.07
See application file for complete search history.

(56) References Cited

U.S. PATENT DOCUMENTS

| | | | | |
|---|---|---|---|---|
| 4,319,125 | A * | 3/1982 | Prince | 126/92 B |
| 4,460,942 | A * | 7/1984 | Pizzuti et al. | 362/16 |
| 5,775,799 | A * | 7/1998 | Forkner | 362/268 |
| 6,641,284 | B2 | 11/2003 | Stopa et al. | |
| 6,648,490 | B2 | 11/2003 | Klose | |
| 6,851,935 | B2 | 2/2005 | Merrill et al. | |
| 7,178,937 | B2 | 2/2007 | McDermott | |
| 7,311,423 | B2 * | 12/2007 | Frecska et al. | 362/372 |
| 2005/0094393 | A1 | 5/2005 | Czajkowski | |
| 2006/0126336 | A1 | 6/2006 | Solomon | |
| 2007/0076414 | A1 | 4/2007 | Holder et al. | |
| 2007/0211487 | A1 | 9/2007 | Sormani | |
| 2008/0025047 | A1 | 1/2008 | Speier et al. | |
| 2009/0290334 | A1 * | 11/2009 | Ivey et al. | 362/219 |

FOREIGN PATENT DOCUMENTS

| | | | |
|---|---|---|---|
| EP | 1653255 | A2 | 5/2006 |
| GB | 2624164 | A | 8/1993 |
| WO | 2004070433 | A2 | 8/2004 |
| WO | 2009036964 | A1 | 3/2009 |

* cited by examiner

*Primary Examiner* — Robert May
(74) *Attorney, Agent, or Firm* — John F. Salazar; Mark L. Beloborodov

(57) ABSTRACT

A light emitting system (1) for outputting a light beam comprising: an optical arrangement comprising at least one light source, for emitting a light beam having a determinate width and a determinate length on a projection plane placed at a determinate distance from the optical arrangement, an optical device (2) movable into a plurality of angular positions, by rotation around a rotation axis (Z1), and comprising optical elements arranged for varying the width of the light beam when the optical device is rotated.

14 Claims, 6 Drawing Sheets

LIGHT EMITTING SYSTEM PRODUCTING BEAM WITH ADJUSTABLE WIDTH

FIELD OF THE INVENTION

The present invention relates to the field of light emitting systems, and more precisely to light emitting systems producing linear and narrow beams.

BACKGROUND OF THE INVENTION

In architectural lighting applications, such as arch lighting, bridge lighting, tunnel lighting, frame lighting, line projection, low height lighting or grazing lighting, a light emitting system producing linear and narrow beams can be more appropriate and/or necessary for emphasizing.

U.S. Pat. No. 6,851,835 discloses such a light emitting system. It comprises a linear reflector having a multi-parabolic-structured shape, a linear array of Light Emitting Diodes, hereinafter designed as LEDs, aligned with a linear focal plane of the reflector. The linear array of LEDs is mounted within the reflector and is oriented so as to face the reflector.

Due to the location of the LEDs along the focal plane of the reflector and to the multi-parabolic-structured shape of this reflector, this light emitting system outputs parallel beam rays and projects a narrow light strip out of the linear array of LEDs and on a long distance. The shape of the light strip produced by this known device depends on the outlet geometry of the reflector.

SUMMARY OF THE INVENTION

An object of the present invention is to improve the known techniques by giving more flexibility for the user to act on the lighting output configuration, while still keeping the possibility to obtain a narrow and/or linear beam.

To this purpose, the invention proposed here is a light emitting system for outputting a light beam, such as a narrow and linear light beam, comprising:

- an optical arrangement comprising at least one light source, for emitting a light beam having a determinate width on a projection plane placed at a determinate distance from the optical arrangement,
- an optical device movable into a plurality of angular positions, by rotation around a rotation axis (Z1), and comprising optical elements arranged for varying the width of the emitted light beam on the projection plane when the optical device is rotated.

Thanks to these features, the light emitting system provides to a user the possibility to easily vary the beam aperture along the width with limited light spilling or light pollution, with a good optical efficiency and at a limited cost.

In particular the invention allows a user, e.g. a lighting creator, to create various light effects on an object by adjusting the width of the narrow beam.

For example, the beam aperture can be modified by rotating the optical device around the rotation axis (Z1) substantially parallel to at least one of said optical axis of said at least one light source.

Each light source might be of any type (incandescent or halogen lamp, HID, LED . . . ) and might be Lambertian or not. The light emitting system may comprise only one light source, preferably placed at the optical centre of the light emitting system, or a plurality of light sources, aligned on a straight or curved axis, or placed according to a straight or curved matrix.

In various embodiments of the light emitting system of the invention, one may have recoursed to at least one and/or other of the following features:

the optical arrangement is arranged to output a light beam generally directed to a determinate direction substantially perpendicular to the optical device;

the optical arrangement comprises a housing comprising reflective walls limiting an inner cavity in which the light source(s) is (are) located and a light outlet;

the optical arrangement further comprises a reflector for back-reflecting the light emitting by the at least one light source towards the optical device; the reflector might have different shape, being plane, convex or concave; this reflector might also be provided by a multilayer filter formed on a substrate or directly on vessel(s) of the light source(s);

the reflector comprises a concave reflective surface facing the optical device; the reflector may comprise a concave reflective surface facing the at least one light source, the reflective surface being transversally concave and extending longitudinally according to a reflector axis (X2), e.g. the concavity of said reflector is a parabola and the at least one light source is located on the focal axis of the parabola; the reflector may further comprises lateral reflective surfaces located laterally to the concave reflective surface; the reflector may be geometrically symmetrical with respect to at least one symmetry plane (P,P'), and the rotation axis (Z1) is contained in this at least one symmetry plane (P,P');

the optical arrangement comprises an arrangement of at least two light sources which are aligned along a light source axis (X1); the light source axis (X1) may be parallel to the reflector axis (X2); the arrangement of light sources may be symmetric with respect to a plane perpendicular to the light source axis (X1); the light sources of each pair of symmetric light sources may emit substantially the same wavelength, the same range of wavelength or the same colour and/or have substantially the same photometric distribution; said arrangement of light sources may be movable into a plurality of angular positions, by rotation around a second rotation axis (Z2) corresponding preferably to said rotation axis (Z1);

the said light source(s) comprises LED(s);

the optical elements of the optical device comprise concave and/or convex elongated optical elements arranged according to parallel arrays or comprise diffraction optical elements forming a diffraction network for diffracting differently along the said width than along the length of the light beam;

the optical arrangement is arranged so as to emit a light beam having a rectangular shape on a projection plane, the said width being the small side of the rectangle.

According to a variant of the invention, the light emitting system for outputting a narrow and linear light beam comprises:

- an arrangement of light sources comprising at least two light sources substantially aligned along an X1-axis,
- a concave reflector consisting in one substantial parabolic concavity and extending along an X2 axis parallel to X1 axis, wherein the reflector is geometrically symmetrical with respect to a symmetry plane P which contains X1 and X2-axis,
- and, possibly, an optical device for widening the light beam back reflected by the reflector, said optical device comprising an array of elongated concave optical elements, an array of elongated convex optical elements, or an array of elongated concave optical elements and of elongated convex optical elements, said elements being parallel to each other and perpendicular to the symmetry plane P; said optical device being movable in a plurality of angular positions, by rotation around an axis Z1 contained in the symmetry plane P and perpendicular to X1, X2.

This variant can also be combined with at least one of the above listed features.

According to the invention as described herein the geometrical features used to define the invention, such as "parallel", "perpendicular or orthogonal" or "symmetric" should be preferably understood as meaning "substantially parallel", "substantially perpendicular or orthogonal" or "substantially symmetric".

These and other aspects, features and advantages of the invention will become apparent to those skilled in the art upon reading the disclosure provided here in connection with the attached drawings. The detailed description, while indicating preferred embodiments of the invention, is only given by way of illustration.

BRIEF DESCRIPTION OF THE DRAWINGS

The invention will now be described in more details by way of an example of one embodiment with reference to the accompanying drawings, in which.

DETAILED DESCRIPTION OF THE INVENTION

Figure 1:
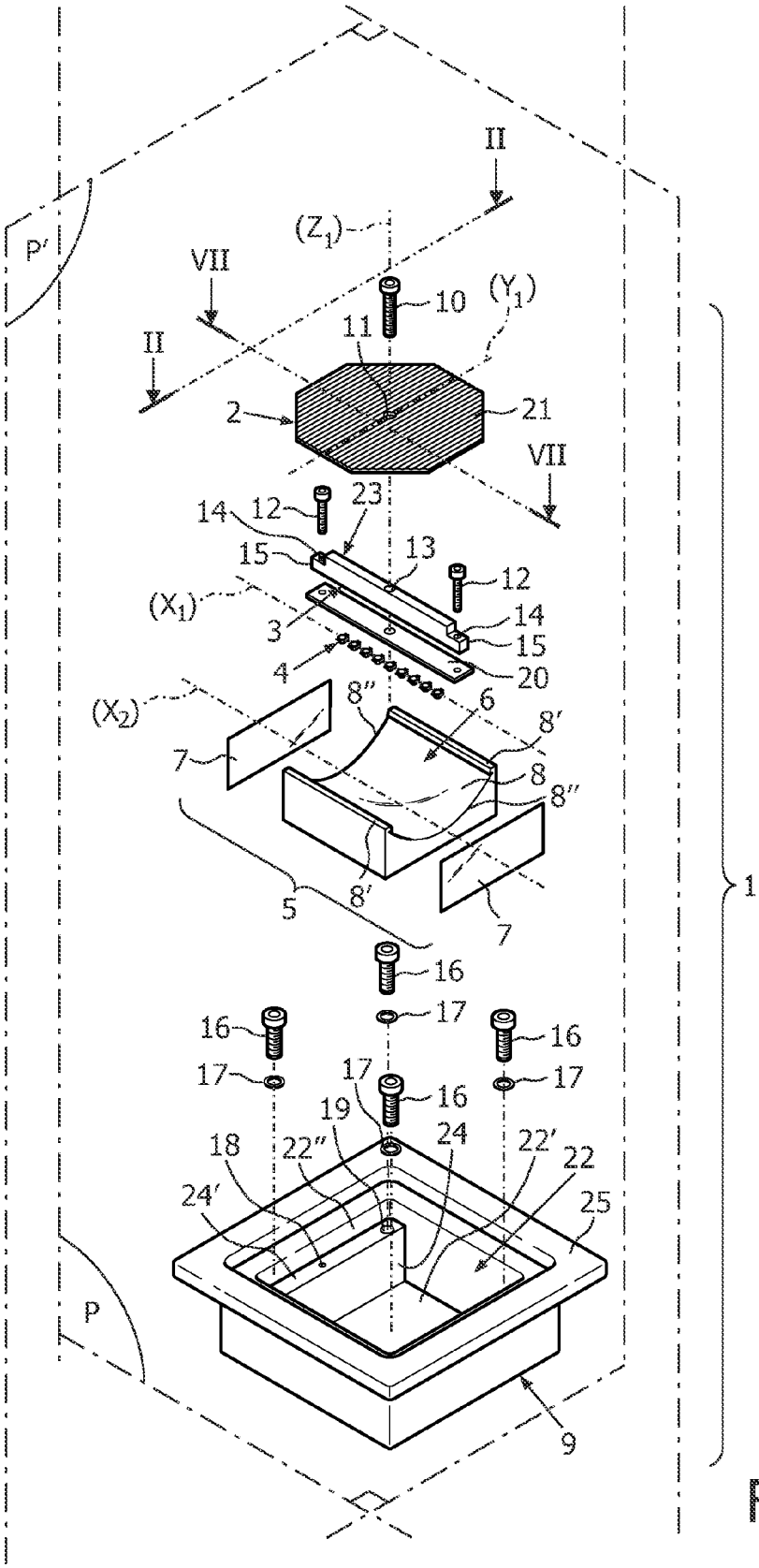
FIG. 1 is an exploded perspective view of a light emitting system according to one embodiment of the invention.

It must be noted that as used in this specification and the appended claims, the singular forms "a", "an", and "the" include plural referents unless the context clearly dictates otherwise. Unless defined otherwise, all technical and scientific terms herein have the same meaning as commonly understood by one of ordinary skill in the art to which this invention belongs.

The foregoing description of preferred embodiments of the invention is not intended to be exhaustive or to limit the invention to the disclosed embodiment. Various changes within the scope of the invention will become apparent to those skilled in the art and may be acquired from practice of the invention. In particular, the housing (9) and the mounting means (10, 16) as described below are optional and/or can be replaced easily by a person skilled in the art with alternative elements having similar effects.

In the various drawings, the same reference numerals designate identical or similar elements.

FIG. 1 shows one embodiment of a light emitting system (1), designed to be used for instance in architectural or emphasizing lighting, such as arch lighting, bridge lighting, tunnel lighting, frame lighting, line projection, low height lighting or grazing lighting.

The light emitting system (1) comprises light sources consisting in a plurality of LEDs (4) on a linear rod (3), a concave reflector (5), an optical device (2) and a housing (9), arranged such that the light emitted by the LEDs (4) is back-reflected by the concave reflector (5) before being transmitted through the optical device (2).

The housing (9) comprises a back face and lateral faces defining a cavity (22) opened at a front side of the housing (9). The cavity (22) comprises a back cavity (22') arranged for fitting the concave reflector (5) within and a front cavity (22") for housing the linear rod (3) and possibly the optical device (2) Inner walls (24) may extend from the back face laterally to the back cavity (22') and have top face (24') adjacent to the front cavity (22"). Some holes (18, 19), possibly threaded, may be provided in the top face (24') so as to receive mounting means (10, 16), e.g. screws. The opened front side of the housing (23) may be of any shape and can be surrounded by large edges (25). The large edges (25) may be used to fix the light emitting system (1) to a casing (e.g. provided in a wall, a ceiling or a floor, or in a larger protective housing) and/or for aesthetical purpose.

The linear rod (3) comprises a Printed Circuit Board (PCB) (20) and a body (23).

The body (23) has a bottom face, a top face, a front face, a rear face and two lateral faces. A centred hole (13) is provided in a central part of the top face of the body (23). Two lateral through holes (14) are respectively provided through lateral sides (15) of the body (23) and are facing respective holes (18) of the housing (9) such that a fixing means (12), e.g. a screw, goes through the holes (14, 18) for fixing the body (23) to the housing (9). At least a part of these holes (13, 14) may be threaded. The body (23) is further preferably arranged for cooling the LEDs (4) and draining the thermal energy off the light emitting system (1). This body (23) might comprise heat pipes, heat sink, and/or conductive thermal material.

Furthermore a contact layer made of a highly thermal conductive material is preferably provided on the LEDs (at the reflector (5) side) for draining the thermal energy supplied by the LEDs to the housing (9).

The PCB (20) is set onto the linear rod (3) with non represented fasteners: it may be fixed by soldering, adhesive means, via the screws (12) and/or by any other suitable fixing means. Support for the plurality of LEDs (4) is provided by the PCB (20). The PCB (20) is arranged for being electrically connected to a power source and possibly a control unit, so as to supply and possibly drive the plurality of LEDs (4).

The plurality of LEDs (4) are arranged so as to be aligned along an axis X1.

Each LED (4) can have the same colour and the same emission type, but can also have different colours and/or different emission type. Thus, it is possible to change the photometric distribution of the output light depending on the application and/or the customer's specific needs. For example, it is possible to use Lambertian, side emitting or batwing type LEDs, solely or together. In another example, it is possible to use simultaneously red, green and blue LEDs, or it is possible to use only one colour, or even to use whatever colour is required, such as amber or whatever.

The LEDs are preferably symmetrically arranged on the linear rod (3) with respect to a symmetry plane (P') perpendicular to X1-axis. More preferably each pair of symmetric LEDs are composed of same colour LEDs. In a variant, the symmetric arrangement of LEDs can comprise an additional LED set on the symmetry plane P'.

Figure 11:
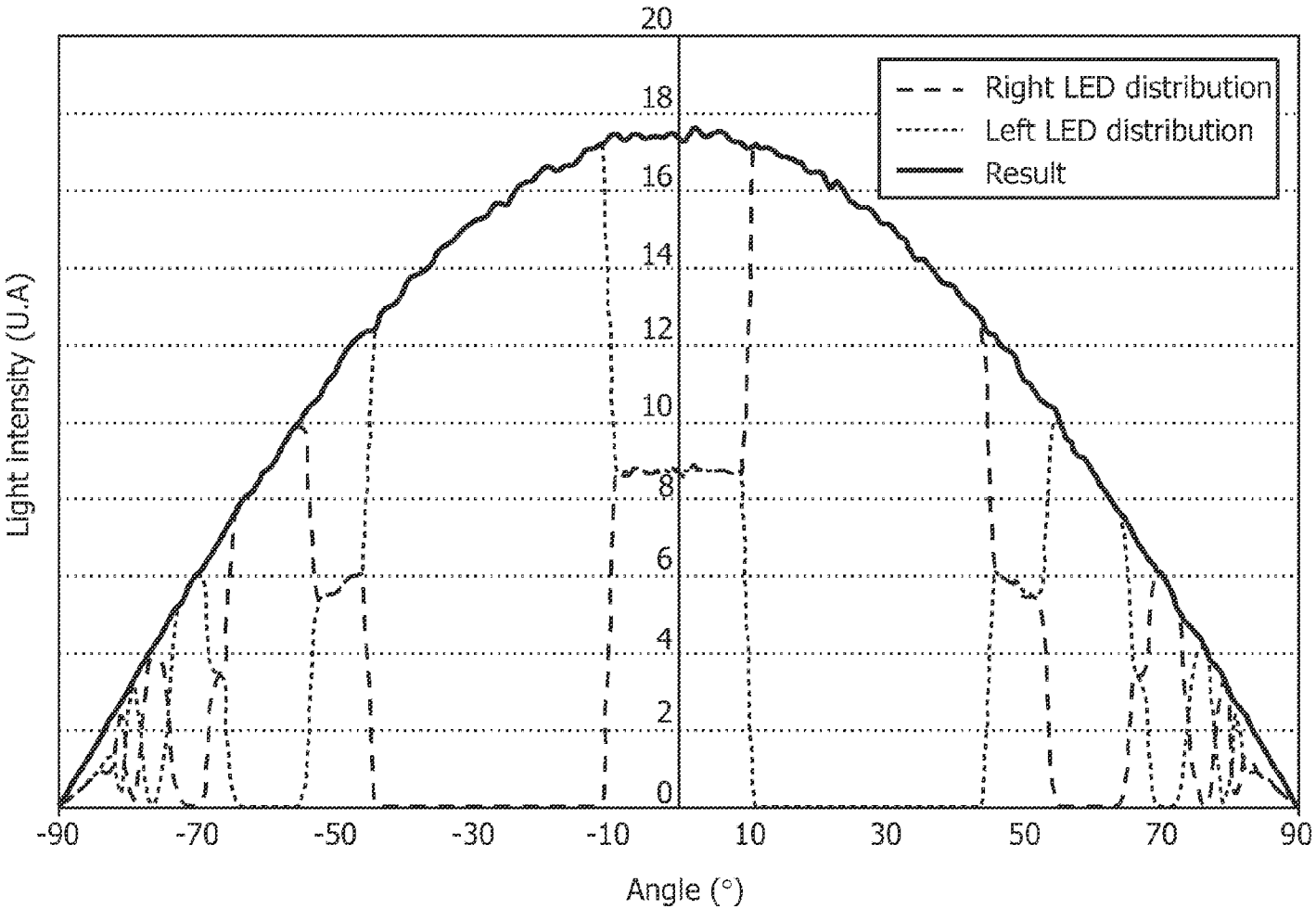
FIG. 11 is the photometric distribution, measured along the length of the emitted beam, of the set of LEDs on the right side of the symmetry plane of the light emitting system of FIG. 1, of the set of LEDs on the left side of the symmetry plane of the light emitting system of FIG. 1, and of the whole set of LEDs.

In this preferred implementation where the LEDs are symmetrical with respect to a symmetry plane P', there is a superposition of the photometric distributions of the two sets of LEDs located on both sides of the symmetry plane. Both sets make a symmetric Lambertian distribution as shown on FIG. 11.

The concave reflector (5) comprises a main body (6), a concave reflective surface (8) and two lateral reflectors (7). The reflective surface (8) extends along an axis X2, said axis X2 being preferably and substantially parallel to the axis X1. The concave reflective surface (8) is preferably symmetric with respect to a plane (P') perpendicular to X2-axis. It might also be symmetric with respect to a plane (P) parallel to X1- and X2-axes.

The concave reflective surface (8) is limited by two first edges (8') in a direction orthogonal to X2-axis and by two second edges (8") in a direction parallel to X2-axis. The distance between the two first edges (8') defines the width of the reflector (5) and the distance between the two second edges (8") defines the length of the reflector (5).

In the subsequent part of this document, the "width" and "length" of the output beam (i.e. coming from the LEDs (4) and back-reflecting by the reflector (5)) are the dimensions of this beam projected on a projection plane perpendicular to the plane (P') which are taken respectively in a direction orthogonal to X2-axis and parallel to X2-axis. It is to be noted that the width and length of the output beam correlates respectively with the width and length of the reflector (5). It is also to be noted that the lateral reflective surfaces (7) of the reflector (5) create an optical cavity for multiple reflections thereon that enlarge the length of the outputting light beam—giving a further feeling of a linear light beam (i.e. a thin and long light beam on a projection plane).

Figure 2:
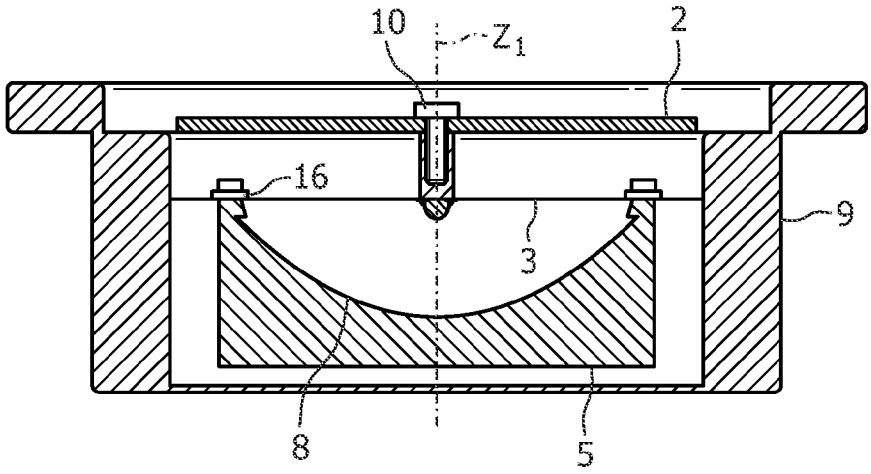
FIG. 2 is a right cross-section view of FIG. 1 according the section line II-II of a cross section plane orthogonal to the median longitudinal plane P.

In this particular embodiment, the cross-section of the reflective surface (8) (i.e. taken perpendicularly to X2-axis) has a paraboloidal shape, as shown in FIG. 2 notably. As a consequence, the reflective surface (8) has one parabolic concavity.

Preferably, X1-axis of the LEDs is on the focal axis of the parabolic reflective surface (8): without any optical device (2), the rays of the beam outputting the reflector (5) are therefore parallel to each other, and the width and length of the beam are substantially equal to, respectively, the width and length of the reflector (5); furthermore, due to such parallel rays, the beam can be projected on a long distance. The beam is therefore narrow and linear.

The concave reflector (5) may be fastened in the back cavity (22') of the housing (9), e.g. by adhesive or soldering means or by means of four washers (17) mounted with four screws (16) in the four screwed holes (19) provided on lateral walls (24') of the housing (9).

In this particular embodiment, the optical device (2) is generally flat and has a substantial hexagonal shape. In another embodiment (not shown) the optical device is a disk which fits in a round front opening of the housing (9).

The optical device (2) can be rotated around a Z1-axis with respect to reflective surface (8), Z1-axis being preferably perpendicular to X2-axis and included in the symmetry plane (P').

To perform the rotation, the optical device (2) may be connected to the linear rod (3) by using for example an arm, a rod, a rivet, a screw (10) passing through a central hole (11) provided at a central location of the optical device (2) and mounted onto the central hole (13) of the body (23). An unrepresented bearing can be disposed between the screw (10) and the optical array (2) in order to facilitate the movement. In the embodiment of the invention represented by FIG. 1, the optical array (2) can be rotated by unlocking the screw (10), turning manually the optical array (2) then locking the screw (10). In other embodiments, mechanical means such as motors or actuators can be employed to automatically rotate the optical surface (2). This, it may be possible to control the motor or the actuator so as to adjust dynamically the rotation angle of the optical array (2).

The optical device (2) comprises optical elements arranged for changing differently the width than the length of the light beam when the optical device is rotated, deforming therefore the shape of the beam depending on the direction of propagation of the rays. For example, the optical elements comprise concave and/or convex elongated optical elements, such as for example cylindrical or semi-cylindrical lens (21) arranged according to parallel arrays, arrays of elongated optical elements (21) extending generally parallel to each others along an axis Y1. This latter is orthogonal to the axis (X1) and to the axis (Z1). Other optical elements can be used, such as for example diffraction optical elements forming diffraction network for diffracting differently in the width than in the length of the light beam. These diffraction elements may for example be holographic diffusers, patterned by printing on transparent surfaces (e.g glass, plastic, polycarbonate).

Figure 7:
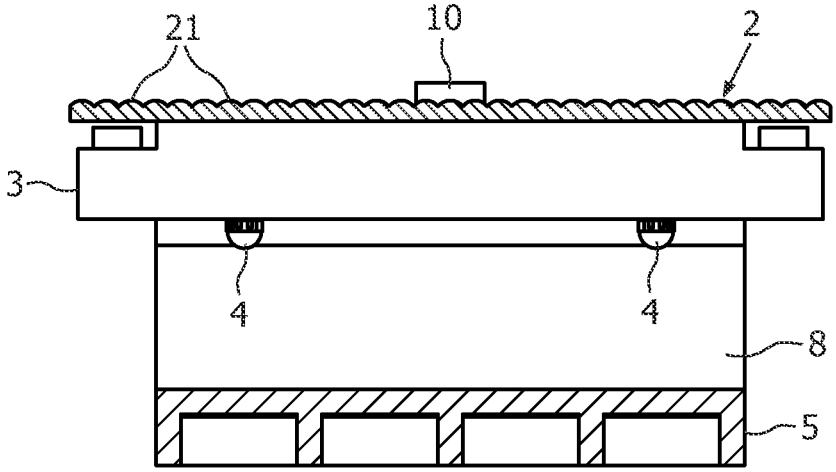
FIG. 7 is a longitudinal section view of FIG. 1 according the section line VII-VII of a section plane parallel to the median longitudinal plane P, the device's housing is not represented and the device's linear LEDs arrangement has two symmetric LEDs.

Preferably, each of the optical elements (21) which compose the array (2) may have a concave and/or a convex profile in right cross section. For example, the optical elongated elements (21) are cylindrical lenses or prismatic lenses. FIG. 7 shows an optical device (2) with convex cylindrical lenses (21).

In some variants of the present embodiment of the invention, each of the optical elements (21) may have a variable or a constant right cross section. There again, the optical elements (21) of the array may be identical or different from each other, with respect to the variable or non-variable right cross section.

It is possible to change the photometric distribution of the output light, by modifying the structure (concave or convex profiles in right cross section) of the optical elements (21) of the array (2) depending on the application and/or the customer's specific needs.

The said rotation of the optical array (2) around the axis Z1 is another mean to change the photometric distribution of the output light.

Convex (or concave) cylindrical lens array (2) has the property to widen (or thin) the output back reflected beam, into a direction perpendicular to the axis of the cylinder (Y1). However, the beam is not significantly modified in a direction parallel to Y1-axis.

If this array is positioned with the cylindrical lenses (21) being perpendicular to X2-axis, there is no significant changes on the width of the beam, and only the length of the beam is widened by the cylindrical lenses (21). Nevertheless, if the concave reflective surface (8) and the lateral reflective surfaces (7) are long enough, and thus the length of the outputting light beam is sufficiently long, the increasing of the length of the light beam by these cylindrical lenses can be not significant and thus negligible.

Figure 3:
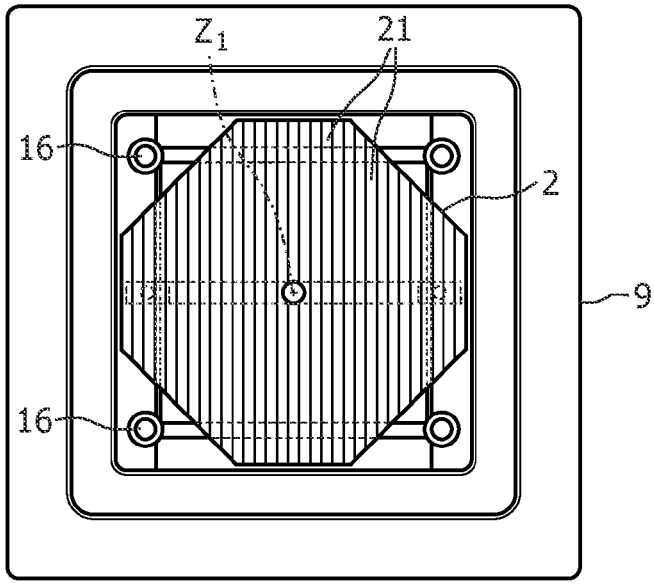
FIG. 3 is a top view of FIG. 1, the optical device being in its initial position.
Figure 8:
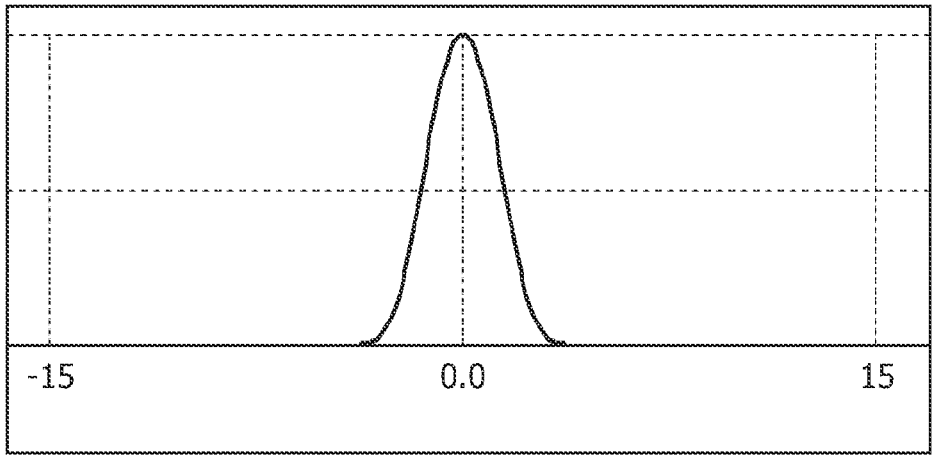
FIG. 8 is the photometric distribution of the width of the beam outputting the light emitting system configured as depicted in FIG. 3.

This is an initial position of the optical device (2) as shown in FIG. 3. It corresponds to the photometric distribution of FIG. 8.

Figure 4:
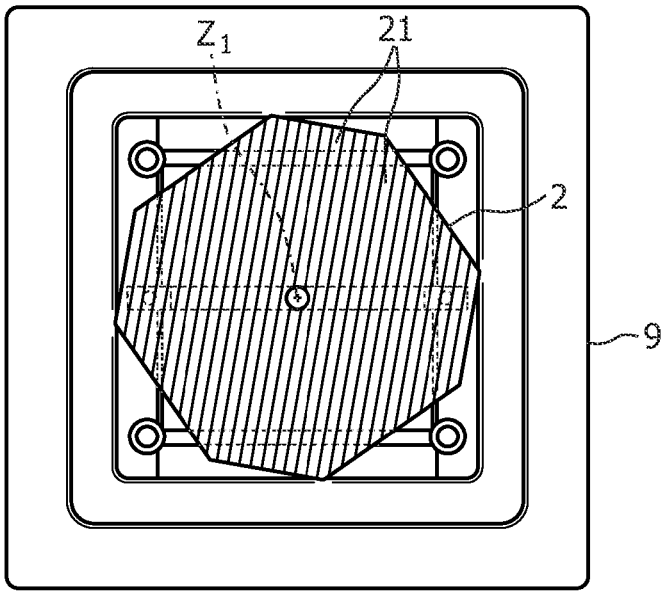
FIG. 4 is a top view of FIG. 1, the optical device being rotated of 10 degrees relatively to $Z_1$ axis.

Now, as depicted by FIG. 4, the optical device (2) is rotated around the Z1-axis from the initial position, offering the possibility to change the beam width differently than the beam length.

Figure 9:
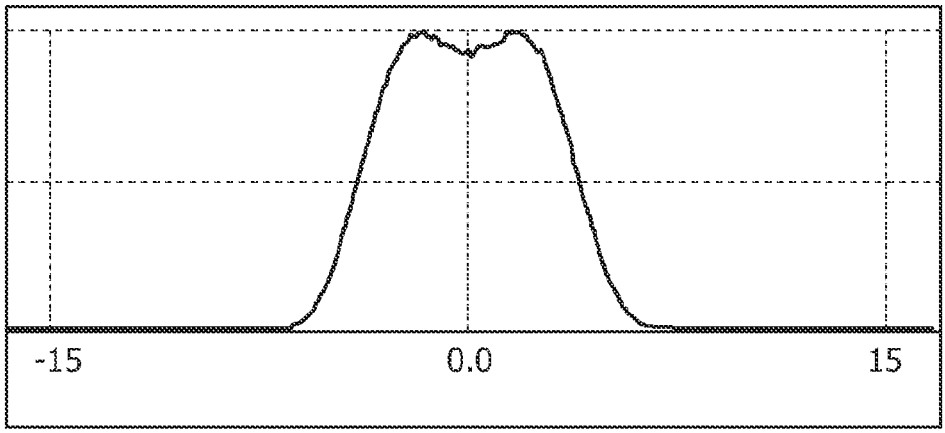
FIG. 9 is the photometric distribution of the width of the beam outputting the light emitting system configured as depicted in FIG. 4.

In FIG. 4, the angle of rotation is 10° from the initial position. This rotation widens the photometric distribution along the width of the output beam, as shown in FIG. 9.

Figure 5:
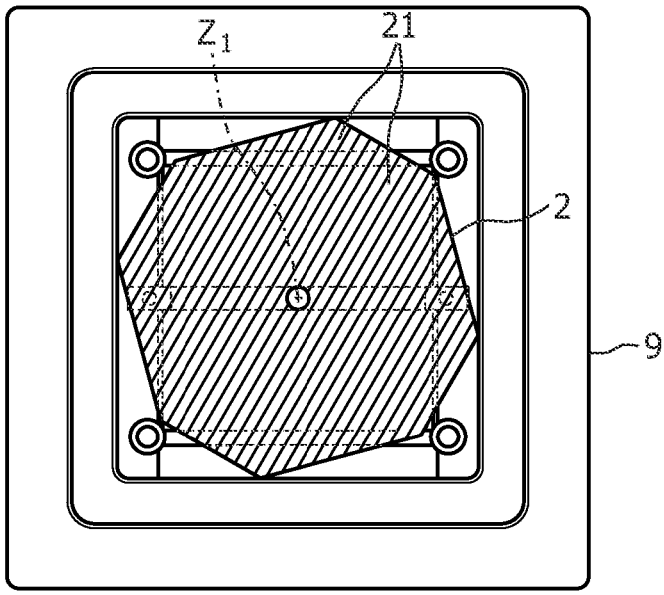
FIG. 5 is a top view of FIG. 1, the optical device being rotated of 30 degrees relatively to $Z_1$ axis.
Figure 10:
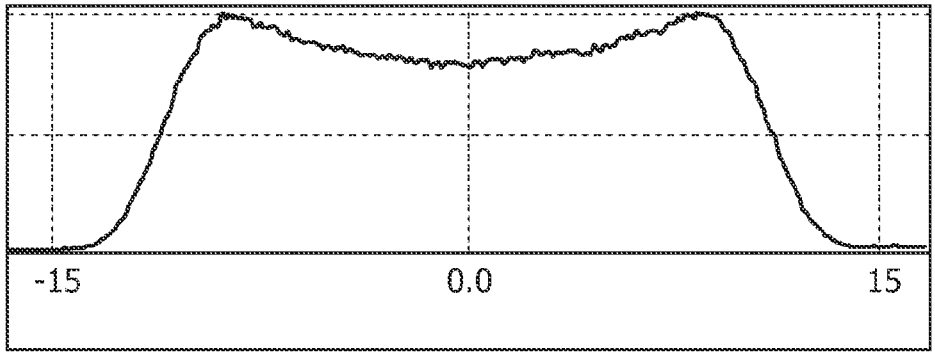
FIG. 10 is the photometric distribution of the width of the beam outputting the light emitting system configured as depicted in FIG. 5.

The widening of said beam can be enhanced thanks to a rotation of 30° angle of the lens array (2) with regard to the initial position of FIG. 3. This larger rotation is represented on FIG. 5 and the subsequent larger photometric distribution is shown on FIG. 10.

Then, from a narrow and linear beam defined by an elongated parabolic reflector (5) and an array of LEDs (4) located at the focal axis of the parabolic reflector (5), the user of the light emitting system can modify the narrow width of the beam as he wants, creates therefore different effects on the object to be lighted.

Figure 6:
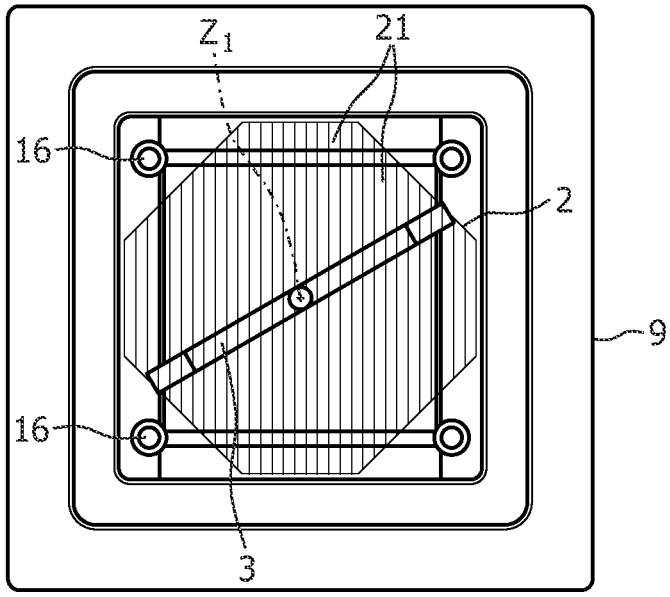
FIG. 6 is a top view of FIG. 1 according to a variant wherein the linear rod being rotated of 30 degrees relatively to Z1 axis.

In the variant represented on FIG. 6, the lens array (2) is in the said initial position (i.e. with the parallel cylindrical lenses orthogonal to X2 and Z1), and the linear arrangement—rod—of LEDs has been turned of an angle of 30° around the axis Z1. It issues therefrom a widening of the output, narrow, linear and back reflected beam. In this variant, the linear rod (3) is not fastened to the housing (9) with the aid of the screws (12). In this case, the assembly composed of the optical device (2) and the linear rod (3) could be connected by any appropriate means (e.g. hanging means, axis of rotation similar as those used for rotating the optical device (2)).

In another variant not shown in the figures, the reflector (5) of light sources (4) could be movable into a plurality of angular positions, by rotation around an axis X3 contained in the symmetry plane P and parallel to X1, X2; X3 corresponding preferably to X1 and X1 is preferably on the focal axis of the parabolic reflector (5). Once this rotation performed, the rays are not perpendicular to the optical device (2).

Conversely or additionally, the linear rod (3) of LEDs (4) can turn around its own median longitudinal axis which is parallel to X1.

The rotations of the reflector (5) and/or of the linear rod (3) according to this variant induce a tilting of the output, narrow, linear and back reflected beam.

The device according to the present invention can be used notably for arches lighting, bridge lighting (by the bottom), line projection, frame lighting (door, corridor, window frame), low height lighting (road, path way, stairs), tunnels lighting (wall or roadway), and grazing lighting (façade or ground).

The invention claimed is:

1. A light emitting system for outputting a light beam comprising an optical arrangement and an optical device, wherein the optical arrangement comprises:

at least one light source for emitting a light beam having a pre-determined width on a projection plane placed at a pre-determined distance from the optical arrangement;

a reflector facing the optical device for back-reflecting the light emitting by the at least one light source towards the optical device, the reflector comprising a transversally concave reflective surface extending longitudinally according to a reflector axis;

wherein the optical device is movable into a plurality of angular positions, by rotation around a rotation axis, and comprises one or more optical elements arranged for varying the width of the emitted light beam on the projection plane when the optical device is rotated;

wherein the optical arrangement comprises an arrangement of at least two light sources which are aligned along a light source axis (X1); and, wherein said arrangement of light sources is movable into a plurality of angular positions by rotation around a second rotation axis corresponding to said rotation axis.

2. A light emitting system according to claim 1, wherein the optical arrangement is arranged to output a light beam generally directed to a determinate direction substantially perpendicular the optical device.

3. A light emitting system according (1) to claim 1, wherein the optical arrangement comprises a housing comprising reflective walls limiting an inner cavity in which the light source(s) is (are) located and a light outlet.

4. A light emitting system as claimed in claim 1, wherein the concavity of said reflector is a parabola and the at least one light source is located on the focal axis of the parabola.

5. A light emitting system as claimed in claim 1, wherein the reflector further comprises lateral reflective surfaces located laterally to the concave reflective surface.

6. A light emitting system as claimed in claim 1, wherein the reflector is geometrically symmetrical with respect to at least one symmetry plane (P,P'), and wherein the rotation axis is contained in this at least one symmetry plane (P,P').

7. A light emitting system as claimed in claim 1, wherein the light source axis (X1) is parallel to the reflector axis (X2).

8. A light emitting system as claimed in claim 1, wherein the arrangement of light sources is symmetric with respect to a plane perpendicular to the light source axis (X1).

9. A light emitting system as claimed in claim 8, wherein the light sources of each pair of symmetric light sources emit substantially the same wavelength, the same range of wavelength or the same colour and/or have substantially symmetric photometric distribution.

10. A light emitting system as claimed in claim 1, wherein the said light source(s) comprise(s) LED(s).

11. A light emitting system as claimed in claim 1, wherein said reflector of light sources is movable into a plurality of angular positions, by rotation around a third rotation axis corresponding to said rotation axis.

12. A light emitting system as claimed in claim 1, wherein the optical elements of the optical device comprise concave and/or convex elongated optical elements arranged according to parallel arrays or comprise diffraction optical elements forming a diffraction network for diffracting differently along the said width than along the length of the light beam.

13. A light emitting system as claimed in claim 1, wherein the optical arrangement is arranged so as to emit a light beam having a rectangular shape on a projection plane.

14. A light emitting system for emitting a light beam, comprising:

a linear array of light sources which emit light having a pre-determined width on a projection plane placed at a pre-determined distance from an optical device;

a reflector facing the linear array of light sources for back-reflecting the light emitted by the linear array of light sources towards the optical device, the reflector including a transversally concave reflective surface extending longitudinally according to a reflector axis;

wherein the optical device is movable into a plurality of angular positions by rotation around a rotation axis, and includes one or more optical elements arranged for varying the width of the emitted light beam on the projection plane when the optical device is rotated;

the light emitting system including said linear array of light sources which are aligned along a light source axis;

said arrangement of light sources is movable into a plurality of angular positions by rotation around said rotation axis.

* * * * *